United States Patent [19]

Gruber

[11] Patent Number: 4,829,684

[45] Date of Patent: May 16, 1989

[54] ROTARY SNOW PLOW WITH FEEDING MECHANISMS

[75] Inventor: Franz Gruber, Vienna, Austria

[73] Assignee: Ing. Alfred Schmidt GmbH, St. Blasien, Fed. Rep. of Germany

[21] Appl. No.: 119,185

[22] Filed: Nov. 10, 1987

[30] Foreign Application Priority Data

Nov. 10, 1986 [DE] Fed. Rep. of Germany ..... 3638283

[51] Int. Cl.[4] ..... E01H 5/09

[52] U.S. Cl. ..... 37/248; 37/256

[58] Field of Search ..... 37/248, 249, 250, 251, 37/253, 255, 256, 257, 258, 209–211

[56] References Cited

U.S. PATENT DOCUMENTS

| | | | |
|---|---|---|---|
| 1,545,235 | 7/1925 | Cole | 37/250 |
| 1,647,723 | 9/1927 | Zinn | 37/248 |
| 1,977,871 | 10/1934 | Christopherson | 37/248 |
| 2,555,948 | 6/1951 | Wallack | 37/248 |
| 2,736,111 | 2/1956 | Moen | 37/248 |
| 4,151,663 | 5/1979 | Schmidt | 37/255 |
| 4,592,156 | 6/1986 | Schmidt | 37/255 |

*Primary Examiner*—Eugene H. Eickholt

*Attorney, Agent, or Firm*—Helfgott & Karas

[57] ABSTRACT

In a rotary snow plow, especially one with a high plowing capacity, with two driven feeding mechanisms (7), which are disposed on either side of the centrifugal wheel (2) and, in the direction of plowing (F), ahead of the centrifugal wheel housing (1), and which rotate in opposite directions about vertical axes and the outside of which in each case is covered totally or partly by a flashing (8), which surrounds the feeding mechanism (7) tightly, the feeding mechanism (7), for the purpose of increasing the plowing performance while using energy sparingly, comprises essentially a cage-like rotor with throwing blades (4) disposed along surface lines and distributed over the circumference, the throwing blades (14), which rotate about vertical axes, also being driven and moreover in a direction opposite to the respective rotation of the feeding mechanism (7).

10 Claims, 4 Drawing Sheets

17
18
1
6
3
18
17
16
14
14
4
2
19
15
14
7
7
13
21
9
10
9
8

ROTARY SNOW PLOW WITH FEEDING MECHANISMS

The invention relates to a rotary snow plow, especially to one with a high plowing capacity, with two driven feeding mechanisms, which are disposed on either side of the centrifugal wheel and, in the direction of plowing, ahead of the centrifugal wheel housing, and which rotate in opposite directions about vertical axes and the outside of which in each case is covered totally or partly by a flashing, which surrounds the feeding mechanism tightly.

A rotary snow plow with such feeding mechanisms is known from the German Pat. No. 2,721,411. The feeding mechanisms there comprise feed screws, which rotate about vertical axes in such a manner, that the snow, which is grasped from the side, is thrown in front of the centrifugal wheel. Such feed screws require power in an amount, which corresponds to the energy needed for the lateral displacement as well as for lifting the grasped snow in proportion to the shape of the screw. If the snow is not dry, it frequently lodges undesirably on the sides of the feed screw, as a result of which its efficiency is reduced. This is also the case with very light, powdery snow, which is partly swirled up by the feeder screws and thus is not supplied directly to the rotary snow plow.

Moreover, rotating drums, from the surface of which short milling blades project, are known as feeding devices for a rotary snow plow (Swiss Pat. No. 309,121). With this known device, the feeding power, which is high under other conditions, is reduced when the rotary snow plow is used in hard snow. Under these conditions, the feeding mechanisms act mainly as milling organs and make little contribution to transporting the snow in front of the centrifugal wheel.

It is therefore an object of the invention to provide a rotary snow plow of the type described with energy-saving feeding mechanisms with a high absorption capacity for high plowing speeds, especially for use on airfields.

This objective is accomplished pursuant to the invention by virtue of the fact that the feeding mechanism comprises essentially a cage-like rotor with throwing blades disposed along surface lines and distributed over the circumference, the throwing blades, which rotate about vertical axes, also being driven and moreover in a direction opposite to the respective rotation of the feeding mechanism.

With such a feeding mechanism, the snow, grasped by the throwing blades, is no longer raised but only thrown in front of the centrifugal wheel. As a result, the energy expended for transporting the snow is reduced. Owing to the fact that the throwing blades rotates, but also as a consequence of their vertical surface, the snow is reliably prevented from lodging on the throwing blades. The result is a rotary snow plow, the absorptive capacity of which is usable to a very high degree as a consequence of the efficient support by the two feeding mechanisms.

The action of the feeding mechanisms is furthermore supported by the front part of the snow plow, which is extended towards the front beyond the feeding mechanisms and which is constructed on either side like a feeding plow. The feeding mechanisms are integrated into the plowshare surface of the feeding plow and partly protrude beyond it—to about half the extent as seen in plan view. Towards the side, namely as far as the feeding mechanisms cut in behind the plowshare surface, the feeding mechanisms are tightly surrounded by flashings, which prevent the snow leaving towards the side or the rear.

In a preferred embodiment, the throwing blades make only half a revolution during a complete revolution of the feeding mechanism. In the foremost position of rotation, the throwing blades are aligned approximately parallel to the plowing direction. In this way, it is possible to insert the throwing blades optimally into the snow, which has collected in the housing of the front part; on the other hand, an optimum dumping angle results in the direction of the vertical center line of the rotary snow plow, the throwing blades in the dumping position assuming an angle of about 45° to the plowing direction. The inherent rotation of the throwing blades is such that, after a quarter rotation of the feeding mechanism, the position of rotation of the throwing blades lags behind that of fixed, radially aligned throwing blades by about a half, that is, by 45°.

Within the scope of the invention, it is essential that the throwing blades do not take up the whole available width within the enveloping surface of the feeding mechanism. For this purpose, the invention provides that the width of the throwing blades, which determines the diameter of their enveloping surface, is between $\frac{1}{3}$ and $\frac{2}{3}$ of the radius of the enveloping surface of the feeding mechanism. In a preferred embodiment, the width is closer to $\frac{1}{3}$.

Advisably, each feeding mechanism is provided with four throwing blades, which are separated mutually by an angle of 45°. This number of four throwing blades is adequate for a feeding mechanism with a rotational speed of the order of more than 500 revolutions per minute.

The throwing blades are driven preferably by means of a driving mechanism from the associated feeding mechanism. The driving mechanism for the feeding mechanism advisably engages the upper end of a central drive shaft. On the other hand, the driving mechanism can engage the rotating shafts of the throwing blades at the upper or the lower end of a rotating shaft. In the case of a chain or a belt drive, for which a chain or a belt is provided for drivng one or two throwing blades, the preferred location for the disposition of the driving mechanism is the upper end of the rotating shafts, which is removed from the snow base. If, however, the driving mechanism is constructed as a planetary drive, it is preferably disposed at the lower end of the rotating shafts. Such a planetary drive preferably is disposed in a gear casing, which rotates with the feeding mechanism.

In the following, an example of the operation of the invention is described by means of the drawing.

Figure 1:
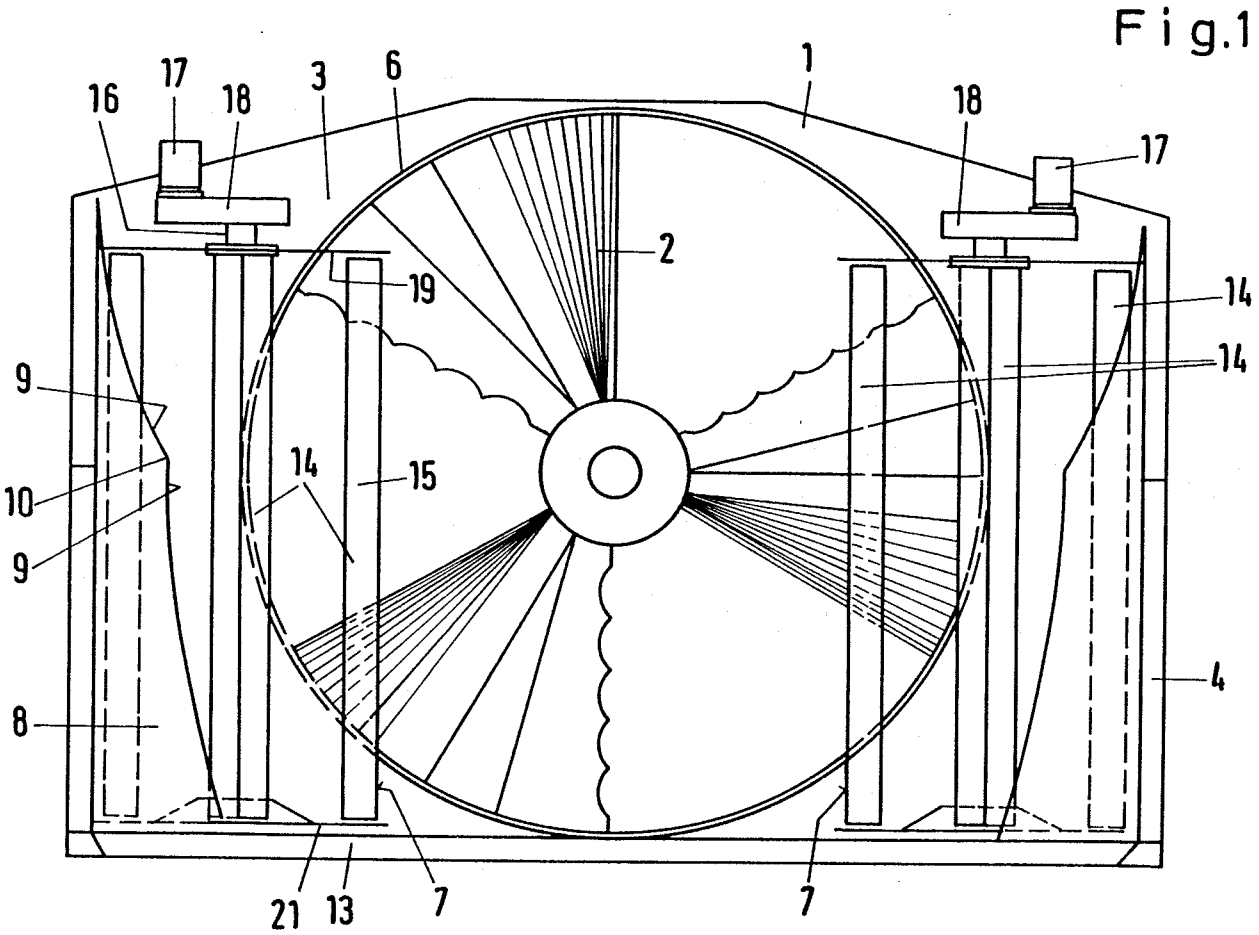
FIG. 1 shows a front view of the rotary snow plow.

FIG. 1 shows the front view of a centrifugal wheel (2) of a rotary snow plow, which is disposed in a housing (1) and is to be mounted on the front of a (not shown) carrier vehicle. A housing apron (3), forming the end of the housing (1) at the front, is drawn forwards at the side down to narrow, vertical faces (4) in the nature of bilateral feeding snow plows with an inwardly turned plowshare surface (5). Feeding mechanisms (7), which laterally overlap with the opening (6) for the centrifugal wheel (2) and are in front of and near the opening (6), are provided on both sides of the centrifugal wheel (2). The feeding mechanisms (7) project with a portion of their circumference into the plowshare surface (5), where they are closely enveloped towards the outside and the rear by flashings (8) (see FIG. 2). The leading edge (9) of the flashings (8) runs from the bottom to the top increasingly towards the outside, forming a bend (10) at about mid height, which marks the the intersecting edge (11) between the ploughshare surface (5) and the upper side (12) of the lateral housing fore-part. A bottom plate (13) forms the boundary of the housing fore-part towards the bottom; throwing blades (14), which can be rotated about the vertical shaft (14), end shortly above the bottom plate (13); four such throwing blades, distributed over the circumference of a feeding mechanism (7), are so disposed. The feeding mechanism (7) has a central drive shaft (16). Both feeding mechanisms (7) are driven over their own hydraulic motor (17) and a gearing (18), further details of which are not shown. The rotating shafts (20) (FIG. 5), shown merely by a dot-dash axis of rotation (15), are rotatably supported at the top in a cover (19) and below in the bottom (21) of the feeding mechanisms (7). The cover (19) and the bottom (21) participate in the rotation of the feeding mechanism (7) about the central drive shaft (16), that is, they are connected to this shaft without being able to rotate independently.

Figure 2:
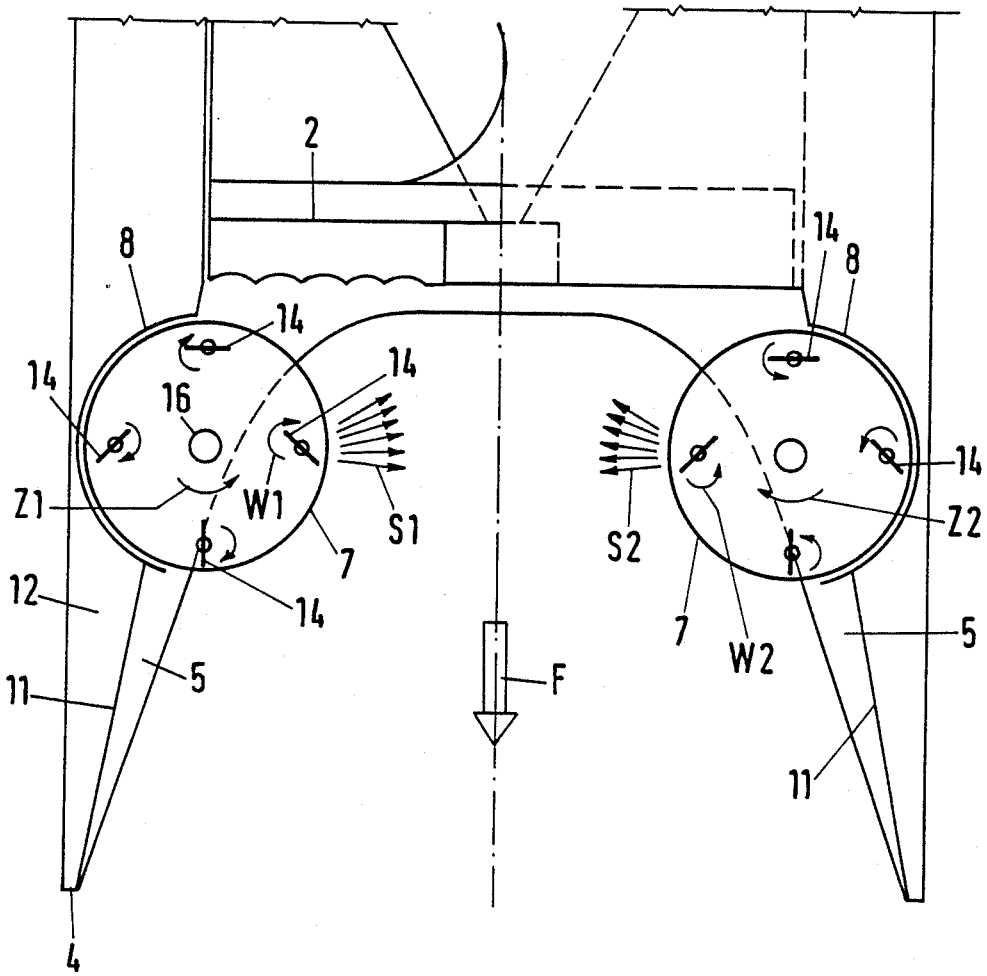
FIG. 2 shows a plan view of the housing fore-part of the rotary snow plow.

It can be seen in the plan view of FIG. 2 that the fore-part housing opens up towards the front with respect to the plowing direction F in the manner of lateral feeder snow plows, the two sides of the housing fore-part forming a plowshare surface (5) towards the inside. The two feeding mechanisms (7) turn in opposite directions, the one on the left turning counterclockwise in the direction shown by arrow Z1 and the one on the right turning clockwise in the direction of arrow Z2. During one revolution of each feeding mechanism (7), the throwing blades (14) complete only half a revolution, the throwing blades (14) of the feeding mechanism on the left turning clockwise, as shown by arrows W1, and those of the feeding mechanism on the right turning anticlockwise, as shown by the arrows W2. Such an arrangement ensures that the throwing blades (14) in the front position are alinged parallel to the plowing direction F; this means that snow flows against them in a position of rotation, which corresponds approximately to the extension of the edge (11) of the housing fore-part, that is, the throwing blades (14) for the first time cut into the snow. The snow is then hurled off in the innermost position of the throwing blade, as indicated by arrows S1, S2.

Figure 3:
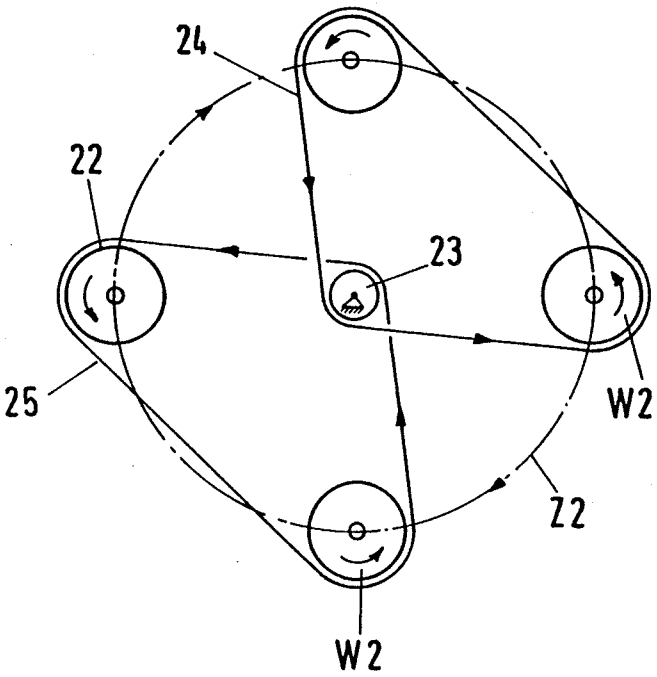
FIG. 3 shows a schematic representation of a belt drive for the throwing blades of the feeding mechanism.

FIG. 3 shows a schematic plan view of pulleys (22), which are connected with the axes of rotation of the throwing blades, so that said pulleys cannot rotate independently, and a central pulley (23). During a rotation of the feeding mechanism, which is indicated by arrow Z2, the outer pulleys (22) are put through one rotation in the counterclockwise direction by the belts (24, 25). This is indicated by the arrows W2 of the feeding mechanism (7) shown in the right half of FIG. 2. Each of the two belts (24, 25) drives two consecutive outer pulleys (22). Four belts, one for each throwing blade, could have been provided equally well. Instead of belts, it is possible to provide chains, which run around on sprocket wheels.

Figure 4:
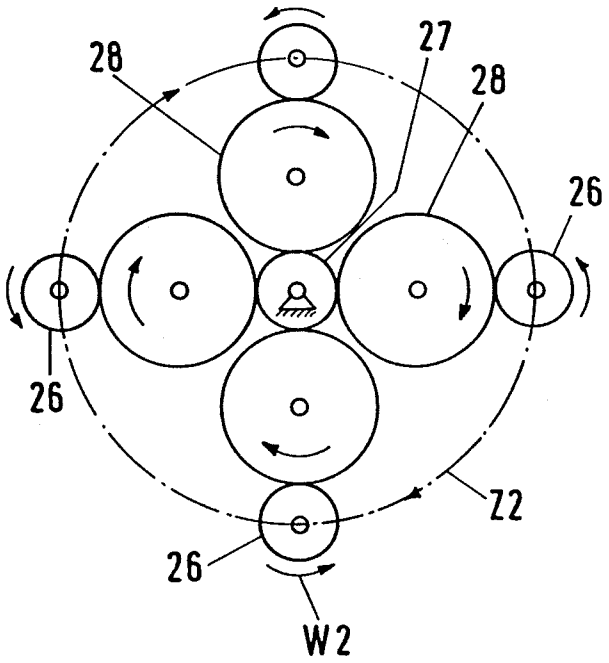
FIG. 4 shows a schematic representation of a planetary drive for the throwing blades of the feeding mechanism.

FIG. 4 shows an alternative driving mechanism in the manner of a planetary drive, as already shown in FIG. 3 in the plan view of the feeding mechanism at the right, corresponding to its direction of rotation Z2. Instead of pulleys, outer planet wheels (26) are connected here, so that they cannot rotate independently, with the axis of rotation (20) of the throwing blades (14). The drive is transferred starting from a central sun wheel (27) over intermediate wheels (28), which mesh, on the one hand, with the stationary sun wheel (27) and, on the other, with the planet wheels (26). The direction of rotation of the intermediate wheels (28) arises out of the counterclockwise rotation of the throwing blades in the direction of arrow W2 for the feeding mechanism at the right, which rotates in the direction Z2. While the planet wheels (26) and the sun wheel (27) have the same number of teeth, the intermediate wheels (28) have twice as many teeth, so that during one revolution of the intermediate wheels (28), the planet wheels (26), to which the throwing blades (14) are attached so that they cannot rotate independently, complete only half a revolution.

Figure 5:
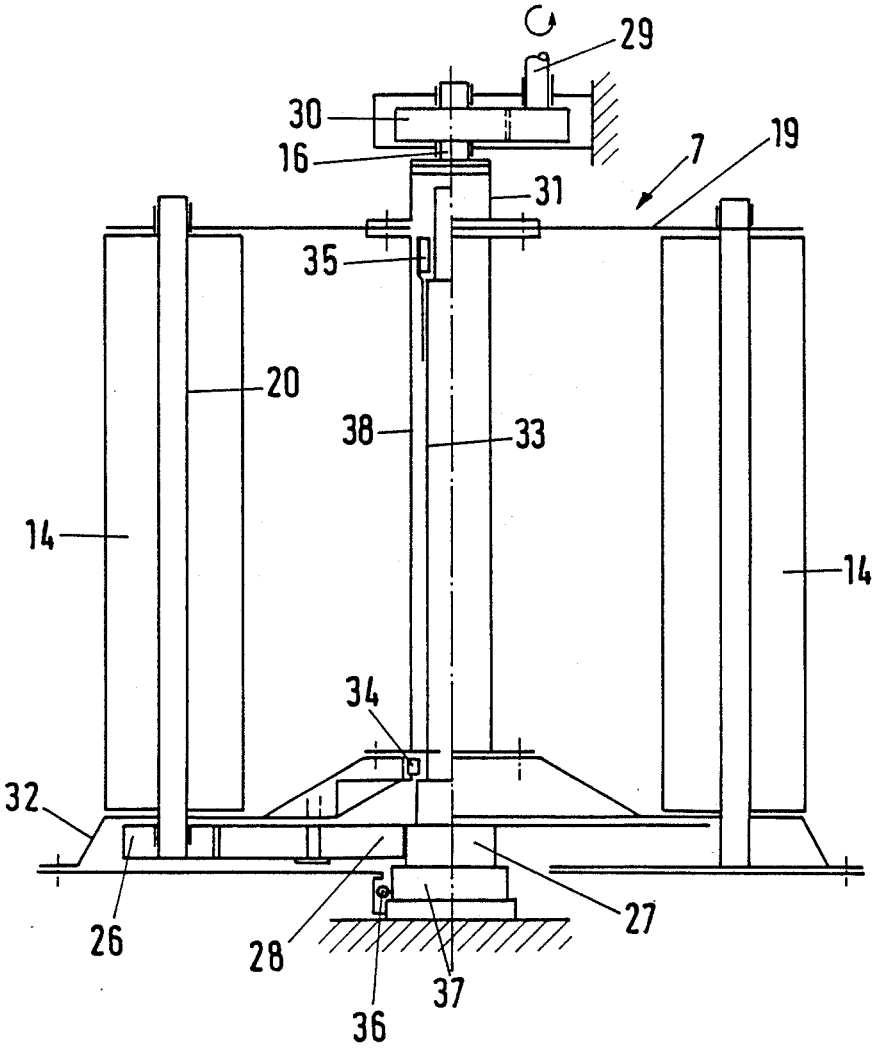
FIG. 5 shows a vertical elevation of a feeding mechanism with a planetary drive.

FIG. 5 shows a feeding mechanism (7) in elevation on a larger scale. The throwing blades (14) of this feeding mechanism (7) are driven by a planetary drive, which is mounted at the bottom. A drive shaft (29). rigidly mounted on the machine and having a drive pinion (30), drives a gearwheel (30), which is connected so as to be incapable of independent rotation with the central drive shaft (16) for the feeding mechanism (7). The drive shaft (16) is connected with a central housing (31), so that neither can rotate independently. The central housing (31), in turn, is connected with the cover (19) of the feeding mechanism (7) in such a manner that, once more, neither can rotate independently. The throwing blades (14) are rotatably supported by means of their rotating shafts (20) at the top in the cover (19) and at the bottom in a rotating gear casing (32) for the planetary drive. A plane wheel (26) is connected with the lower end of each rotating shaft (20) so as to be incapable of independent rotation. The rotation of this planet wheel (26) is controlled over intermediate wheels (28), which, in turn, mesh with the central sun wheel (27). In the period in which the feeding mechanism (7) rotates once about its axis, the planet wheels (26) complete only half a revolution, since they have only half as many teeth as the intermediate wheels (28). The sun wheel (27) is located at the lower end of a stationary central shaft (33), at the lower end of which the gear casing (32) is supported over a thrust ball bearing (34) and at the upper end of which a fixed central pipe (28) with cover (19) and gear casing (32) is supported over a radial bearing (35). At the lower end, the gear casing (32) is supported over a ball bearing (36) at a central disk (37), which is attached at the lower side of the sun wheel (27).

I claim:

1. A rotary snow plow, especially one with a high plowing capacity, comprising a housing, a centrifugal wheel disposed in said housing, two driven feeding mechanisms, which are disposed on either side of the centrifugal wheel and, in a direction of plowing (F), ahead of the housing, and which rotate in opposite directions about vertical axes and an outside of each of which is covered at least partly by a flashing, which surrounds the feeding mechanism tightly, wherein each feeding mechanism comprises essentially a cage-like rotor with throwing blades disposed along surface lines and distributed over the circumference thereof, the throwing blades rotating about vertical axes and being driven in a direction opposite to the respective rotation of the feeding mechanism.

2. The rotary snow plow of claim 1, wherein the throwing blades complete only half a revolution while the feeding mechanism completes a whole revolution, the throwing blades being aligned in their foremost position of rotation approximately parallel to the plowing direction (F).

3. The rotary snow plow of claim 1, wherein the width of the throwing blades, which determines the diameter of their enveloping surface, is between $\frac{1}{3}$ and $\frac{2}{3}$ of the radius of the enveloping surface of each feeding mechanism.

4. The rotary snow plow of claim 1, wherein each feeding mechanism has four throwing blades, which are separated mutually by 45°.

5. The rotary snow plow of claim 1, wherein the throwing blades are driven by means of a driving mechanism from the associated feeding mechanism.

6. The rotary snow plow of claim 5, wherein the driving mechanism is constructed as a chain drive, one chain being provided for at least one throwing blade.

7. The rotary snow plow of claim 5, wherein the driving mechanism is constructed as a planetary drive disposed in a gear casing, which rotates with the feeding mechanism and in which a central sun wheel is provided and a planet wheel is connected with each shaft of a throwing blade so as to prevent independent rotation.

8. The rotary snow plow of claim 7, wherein an intermediate wheel is disposed between the sun wheel and each planet wheel, the number of teeth of the intermediate wheel being twice that of the sun wheel, said sun wheel and said planet wheel having the same number of teeth.

9. The rotary snow plow of claim 5, wherein the driving mechanism is constructed as a belt drive, one belt being provided for at least one throwing blade.

10. The rotary snow plow of claim 7, wherein an intermediate wheel is disposed between the sun wheel and each planet wheel, the number of teeth of the intermediate wheel being twice that of the planet wheel, said sun wheel and said planet wheel having the same number of teeth.

* * * * *